US008857326B2

(12) United States Patent
Koshimizu

(10) Patent No.: US 8,857,326 B2
(45) Date of Patent: Oct. 14, 2014

(54) ELECTRIC SERVO PRESS MACHINE

(71) Applicant: Aida Engineering, Ltd., Kanagawa (JP)

(72) Inventor: Takashi Koshimizu, Kanagawa (JP)

(73) Assignee: Aida Engineering, Ltd., Kanagawa (JP)

( * ) Notice: Subject to any disclaimer, the term of this patent is extended or adjusted under 35 U.S.C. 154(b) by 89 days.

(21) Appl. No.: 13/673,427

(22) Filed: Nov. 9, 2012

(65) Prior Publication Data

US 2013/0118364 A1 May 16, 2013

(30) Foreign Application Priority Data

Nov. 11, 2011 (JP) ..... 2011-248013

(51) Int. Cl.
*B30B 15/14* (2006.01)
*B30B 1/26* (2006.01)

(52) U.S. Cl.
CPC ..... *B30B 15/142* (2013.01); *B30B 1/266* (2013.01); *B30B 15/148* (2013.01)
USPC ..... 100/43; 100/280

(58) Field of Classification Search
CPC .... B30B 15/14; B30B 15/142; B30B 15/148; B30B 15/0041
USPC ..... 100/43, 48, 214, 280, 282; 700/165, 700/206
See application file for complete search history.

(56) References Cited

U.S. PATENT DOCUMENTS

| | | | | |
|---|---|---|---|---|
| 6,654,661 | B2 * | 11/2003 | Schmitz | 700/206 |
| 7,187,996 | B2 * | 3/2007 | Tanaka et al. | 700/206 |
| 2011/0109257 | A1 * | 5/2011 | Someya | 318/626 |

FOREIGN PATENT DOCUMENTS

| | | | |
|---|---|---|---|
| JP | 2007-319917 | A | 12/2007 |
| JP | 2008-105047 | A | 5/2008 |
| JP | 2010-089148 | A | 4/2010 |

* cited by examiner

*Primary Examiner* — Jimmy T Nguyen
(74) *Attorney, Agent, or Firm* — McDermott Will & Emery LLP

(57) ABSTRACT

An electric servo press machine is configured to convert a rotation of an electric servomotor into a reciprocating linear motion of a slide to perform press working on a workpiece. The machine includes a clutch mechanism interposed in a power transmission path between the servomotor and the slide, and a brake mechanism for applying a brake onto the slide under a disconnected state in which the servomotor and the power transmission path are decoupled from each other by the clutch mechanism. The machine brings the clutch mechanism into the disconnected state and applies the brake onto the slide upon an immediate stop request, and recovers from immediate stop under a state in which a phase shift between the servomotor and the power transmission path ranging from the clutch mechanism in the disconnected state to the slide is eliminated under a connected state of the clutch mechanism.

7 Claims, 5 Drawing Sheets

CONTROL FLOW CHART

TIMING CHART

CONTROL FLOW CHART

TIMING CHART

ELECTRIC SERVO PRESS MACHINE

RELATED APPLICATIONS

This application claims the benefit of Japanese Application No. 2011-248013, filed on Nov. 11, 2011, the disclosure of which the Application is incorporated by reference herein.

FIELD OF THE INVENTION

The present invention relates to an electric servo press machine which converts a rotation of a servomotor into a vertical reciprocating motion of a slide through an intermediation of a power transmission/conversion mechanism, and utilizes the vertical reciprocating motion of the slide to perform press working on a workpiece.

BACKGROUND

There is known a pressing machine (so-called electric servo press machine (pressing machine); the press machine (pressing machine) may be hereinafter referred to simply as "press") which converts a rotation of an electric servomotor under electronic control into a vertical reciprocating motion of a slide through an intermediation of a power transmission/conversion mechanism (for example, a crank mechanism), and utilizes the vertical reciprocating motion of the slide to perform press working on a workpiece.

A growing number of electric servo presses have been employed due to their advantages in that an operation status thereof can be controlled by software with a high degree of freedom, and the apparatus can be reduced in cost and size.

By the way, when stopping the slide in the electric servo press, the slide is normally stopped through control of the electric servomotor itself.

However, when stopping the slide due to abnormality in the servo such as a servo error and a positional error, or when stopping the slide by issuing an emergency stop signal from an emergency stop device due to button operation performed by a person or detection of intrusion into a dangerous area, the slide needs to be stopped immediately. Therefore, it is necessary to turn OFF supply of drive power to the servomotor and to stop the slide using a brake that is installed separately.

In this case, in the electric servo press, the electric servomotor and the slide are constantly coupled to each other through an intermediation of drive components such as gears, and hence, when stopping the slide, even the rotation of the electric servomotor needs to be stopped.

At this time, as the inertia of the moving body to be stopped becomes larger, it becomes more difficult to stop the moving body, and hence a certain length of time is required to stop the moving body. Thus, in order to meet the demand that the slide be stopped within a period of time which ensures safety as in the case of the emergency stop, a large-capacity brake is necessary. Therefore, the electric servo press machine is increased in size and cost.

Note that, the immediate stop refers to stop of the slide within a period of time which ensures safety after the reception of the emergency stop signal.

In view of the above, Japanese Patent Application Laid-Open No. 2007-319917 discloses an electric servo press machine including a clutch and a brake device provided in a power transmission path as in a case of a conventional mechanical press, in which an electric motor and a crankshaft can completely be disconnected from each other in a physical (mechanical) manner, and at the time of abnormality, the clutch is released to stop the power transmission, and the brake is actuated to perform emergency stop of the press machine.

The electric servo press machine disclosed in Japanese Patent Application Laid-Open No. 2007-319917 includes the clutch and the brake device provided in the power transmission path, and at the time of emergency stop, the clutch is released to stop the drive transmission of the servomotor, and the brake is actuated. With this configuration, the electric servomotor can be excluded from the components to be stopped, and hence the inertia of the moving body to be stopped can be reduced. As a result, the capacity of the brake can be reduced, thereby contributing to suppression of the capacity increase of the electric servo press machine.

However, when the electric servomotor and the crankshaft (slide) are decoupled from each other by the clutch mechanism as described above, the phases of the electric servomotor and the crankshaft are shifted from each other (synchronization therebetween is not achieved). Therefore, when the clutch mechanism is directly connected for the recovery to the normal operation, troubles may occur in the press working after the recovery and further in cooperative working with other apparatus and facilities in a press working line, which is not a stand-alone system but is a system configured in cooperation with other apparatus and facilities.

SUMMARY OF THE INVENTION

The present invention has been made in view of the above-mentioned circumstances, and the present invention provides an electric servo press machine which drives a slide via a power transmission path using an electric servomotor in a relatively simple and cost-efficient configuration. The electric servo press machine includes a clutch mechanism and a brake mechanism provided in the power transmission path, and at the time of, for example, immediate stop, the electric servomotor is disconnected from the power transmission path by the clutch mechanism, and the brake mechanism is actuated to stop the slide. In this electric servo press machine, when the electric servomotor is connected to the power transmission path again by the clutch mechanism, a phase shift between the electric servomotor side and the slide side can be eliminated, thereby smoothly recovering the operation to a normal operation.

Thus, according to an exemplary embodiment of the present invention, there is provided an electric servo press machine, which converts a rotation of an electric servomotor into a reciprocating linear motion of a slide through an intermediation of a power transmission/conversion mechanism, and utilizes the reciprocating linear motion of the slide to perform press working on a workpiece, the electric servo press machine including: a clutch mechanism interposed in a power transmission path between the electric servomotor and the slide; and a brake mechanism capable of applying a brake onto a motion of the slide under a disconnected state in which the electric servomotor and the power transmission path are decoupled from each other by the clutch mechanism, the electric servo press machine being configured to: bring the clutch mechanism into the disconnected state and apply the brake onto the motion of the slide by the brake mechanism in response to an immediate stop request; and recover from immediate stop under a state in which a phase shift between the electric servomotor and the power transmission path ranging from the clutch mechanism in the disconnected state to the slide is eliminated under a connected state of the clutch mechanism.

In this case, the present invention encompasses a configuration in which the clutch mechanism is connected and then the phase shift is eliminated, and a configuration in which the clutch mechanism is connected under a state in which the phase shift is eliminated.

In the present invention, the electric servo press machine may further include: a servomotor rotational angle position information acquiring device which acquires actual rotational angle position information of the electric servomotor; a slide-side rotating body rotational angle position information acquiring device which acquires actual rotational angle position information of a rotating body located in the power transmission path ranging from the clutch mechanism in the disconnected state to the slide; and a control device which corrects the actual rotational angle position information of the electric servomotor, which is acquired by the servomotor rotational angle position information acquiring device, so that the actual rotational angle position information of the electric servomotor matches with the actual rotational angle position information of the rotating body on the slide side, which is acquired by the slide-side rotating body rotational angle position information acquiring device, to thereby eliminate the phase shift between the electric servomotor and the power transmission path ranging from the clutch mechanism in the disconnected state to the slide.

In the present invention, the electric servo press machine may further include: a servomotor rotational angle position information acquiring device which acquires actual rotational angle position information of the electric servomotor; a slide-side rotating body rotational angle position information acquiring device which acquires actual rotational angle position information of a rotating body located in the power transmission path ranging from the clutch mechanism in the disconnected state to the slide; and a control device which causes the electric servomotor to rotationally move so that the actual rotational angle position information of the electric servomotor, which is acquired by the servomotor rotational angle position information acquiring device, matches with the actual rotational angle position information of the rotating body on the slide side, which is acquired by the slide-side rotating body rotational angle position information acquiring device, to thereby eliminate the phase shift between the electric servomotor and the power transmission path ranging from the clutch mechanism in the disconnected state to the slide.

In the present invention, when recovering from the immediate stop, under a state in which a load is applied to the power transmission path ranging from the clutch mechanism in the disconnected state to the slide so as to prevent at least a backlash, the servomotor rotational angle position information acquiring device may acquire the actual rotational angle position information of the electric servomotor, and the slide-side rotating body rotational angle position information acquiring device may acquire the actual rotational angle position information of the rotating body on the slide side.

In the present invention, the electric servo press machine may further include a mechanism for applying the load to the power transmission path ranging from the clutch mechanism in the disconnected state to the slide, the mechanism utilizing a slide suspension force of a balance cylinder to apply the load to the power transmission path.

According to the present invention, it is possible to provide the electric servo press machine which drives the slide via the power transmission path using the electric servomotor in a relatively simple and cost-efficient configuration. The electric servo press machine includes the clutch mechanism and the brake mechanism provided in the power transmission path, and at the time of, for example, immediate stop, the electric servomotor is disconnected from the power transmission path by the clutch mechanism, and the brake mechanism is actuated to stop the slide. In this electric servo press machine, when the electric servomotor is connected to the power transmission path again by the clutch mechanism, the phase shift between the electric servomotor side and the slide side can be eliminated, thereby smoothly recovering the operation to the normal operation.

DETAILED DESCRIPTION OF THE PREFERRED EMBODIMENTS

In the following, embodiments of the present invention are described with reference to the accompanying drawings. Note that, the present invention is not limited to the embodiments described below.

First Embodiment

Figure 1:
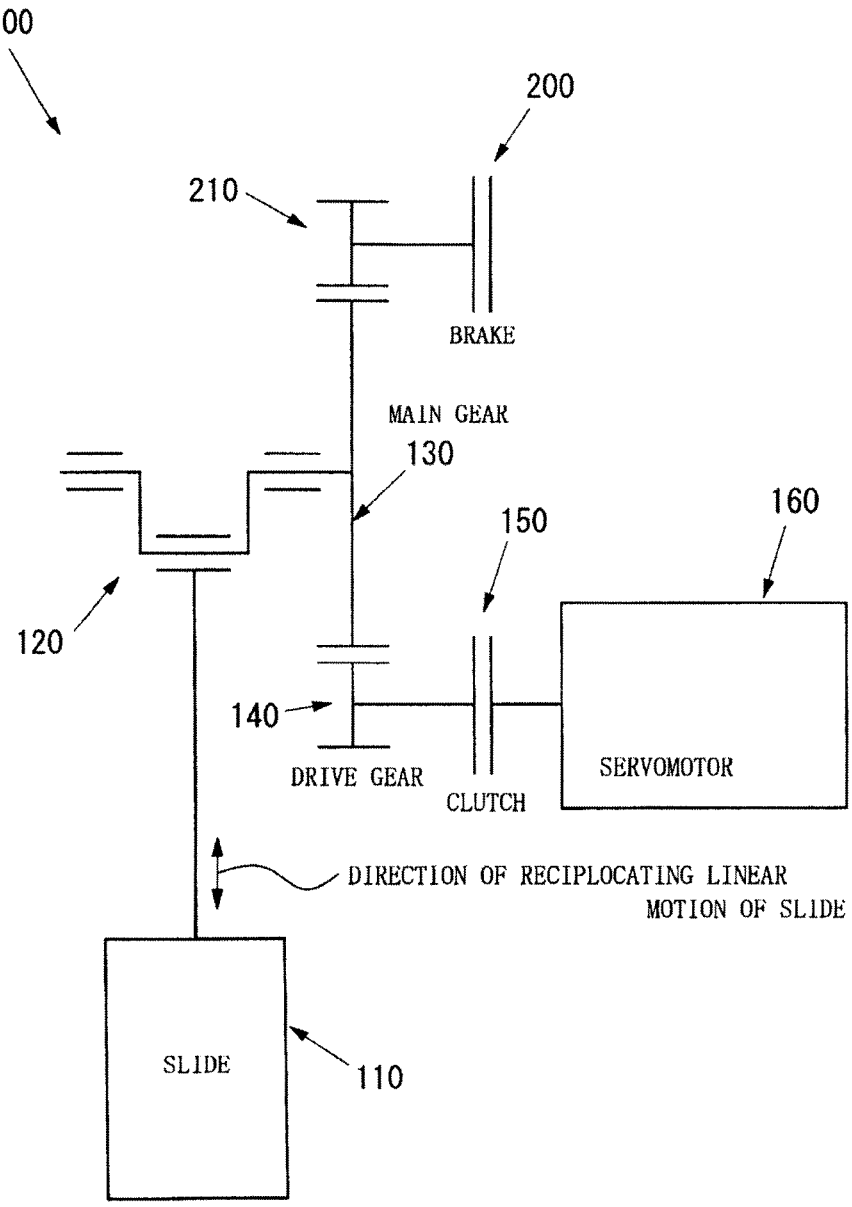
FIG. 1 is an overall configuration diagram schematically illustrating an overall configuration of a mechanical part of an electric servo press machine according to first and second embodiments of the present invention.
Figure 2:
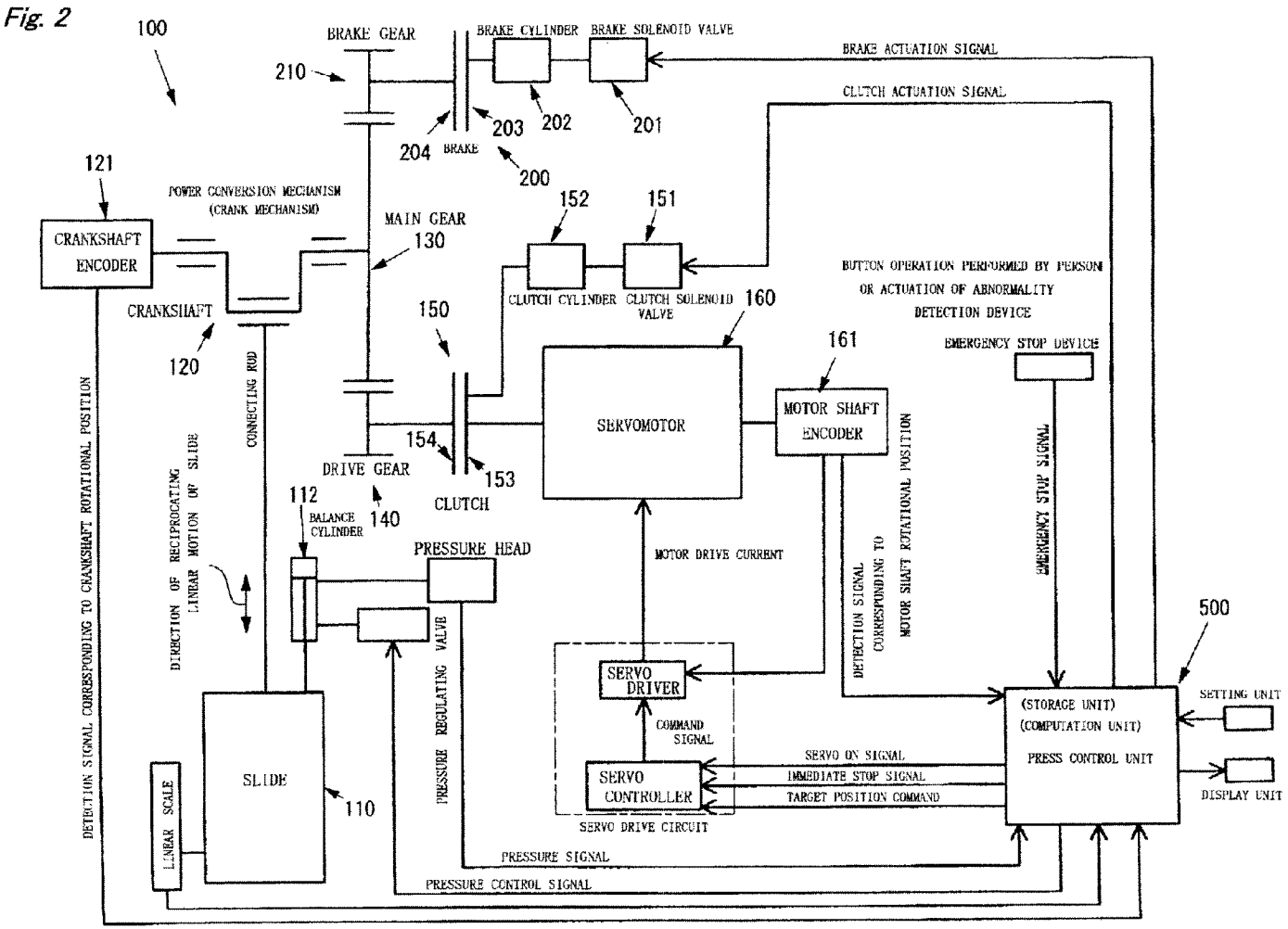
FIG. 2 is a system block diagram schematically illustrating a system configuration of the electric servo press machine according to the first and second embodiments.

As illustrated in FIGS. 1 and 2, an electric servo press machine 100 according to a first embodiment of the present invention includes a crank mechanism (which may be constructed as a mechanism utilizing an eccentric shaft or the like) including a crankshaft 120 as one of "rotary-to-reciprocating linear motion conversion mechanisms" for linearly reciprocating a slide 110 which performs press working on a workpiece.

A main gear 130 is integrally mounted on the crankshaft 120, and a drive gear 140 and a brake gear 210 mesh with the main gear 130.

An electric servomotor 160 as a drive source of the electric servo press machine 100 according to the present invention is rotationally coupled to a rotation shaft of the drive gear 140, and a clutch mechanism 150 is interposed between the drive gear 140 and the electric servomotor 160.

As the clutch mechanism 150, an electromagnetic clutch mechanism or other various types of clutch mechanism may be employed. For example, a mechanical clutch mechanism may be employed.

As illustrated in, for example, FIG. 2, the mechanical clutch mechanism may be configured in the following manner. That is, a clutch solenoid valve 151 is actuated in accordance with a control signal from a press control unit 500 to supply air into a clutch cylinder 152, and accordingly a friction element 153 is pressed on a disc 154 against a biasing force of a spring (not shown), to thereby achieve a connected state which enables power transmission. On the other hand, the clutch solenoid valve 151 is actuated to discharge the air from the clutch cylinder 152, and accordingly the friction element 153 is separated from the disc 154 due to the biasing force of the spring, to thereby achieve a disconnected state.

Further, in this embodiment, a brake mechanism 200 is mounted on the brake gear 210.

As the brake mechanism 200, an electromagnetic brake mechanism or other various types of brake mechanism may be employed. For example, a mechanical brake mechanism may be employed.

As illustrated in, for example, FIG. 2, the mechanical brake mechanism may be configured in the following manner. That is, a brake solenoid valve 201 is actuated in accordance with a control signal from the press control unit 500 to discharge air from a brake cylinder 202. Accordingly, air pressure applied against a biasing force of a spring (not shown) is relieved (released), and a friction element 203 is pressed on a disc 204 due to the biasing force of the spring, to thereby apply a brake onto the brake gear 210 and therefore the main gear 130.

In the electric servo press machine 100 according to this embodiment configured as described above, when normally stopping the electric servo press machine 100, the operation is stopped through operation control of the electric servomotor 160, which is performed by the press control unit 500 via a servo controller. When immediately stopping the electric servo press machine 100 at the time of emergency (in the urgent case) in which an emergency stop signal is issued, the press control unit 500 turns OFF drive power of the electric servomotor 160, while releasing the rotational coupling between the drive gear 140 and the electric servomotor 160 via the clutch mechanism 150 to disconnect the electric servomotor 160 from the power transmission path. Further, the brake mechanism 200 is actuated to apply a brake onto the brake gear 210 and therefore the main gear 130, and further onto the slide 110. Thus, the electric servo press machine 100 is stopped immediately (see Step 1 (S1) to Step 4 (S4) in a control flow chart of FIG. 3A).

When recovering the operation after the immediate stop to resume the normal press working, the following processing is performed in this embodiment.

Figures 3A, 3B:
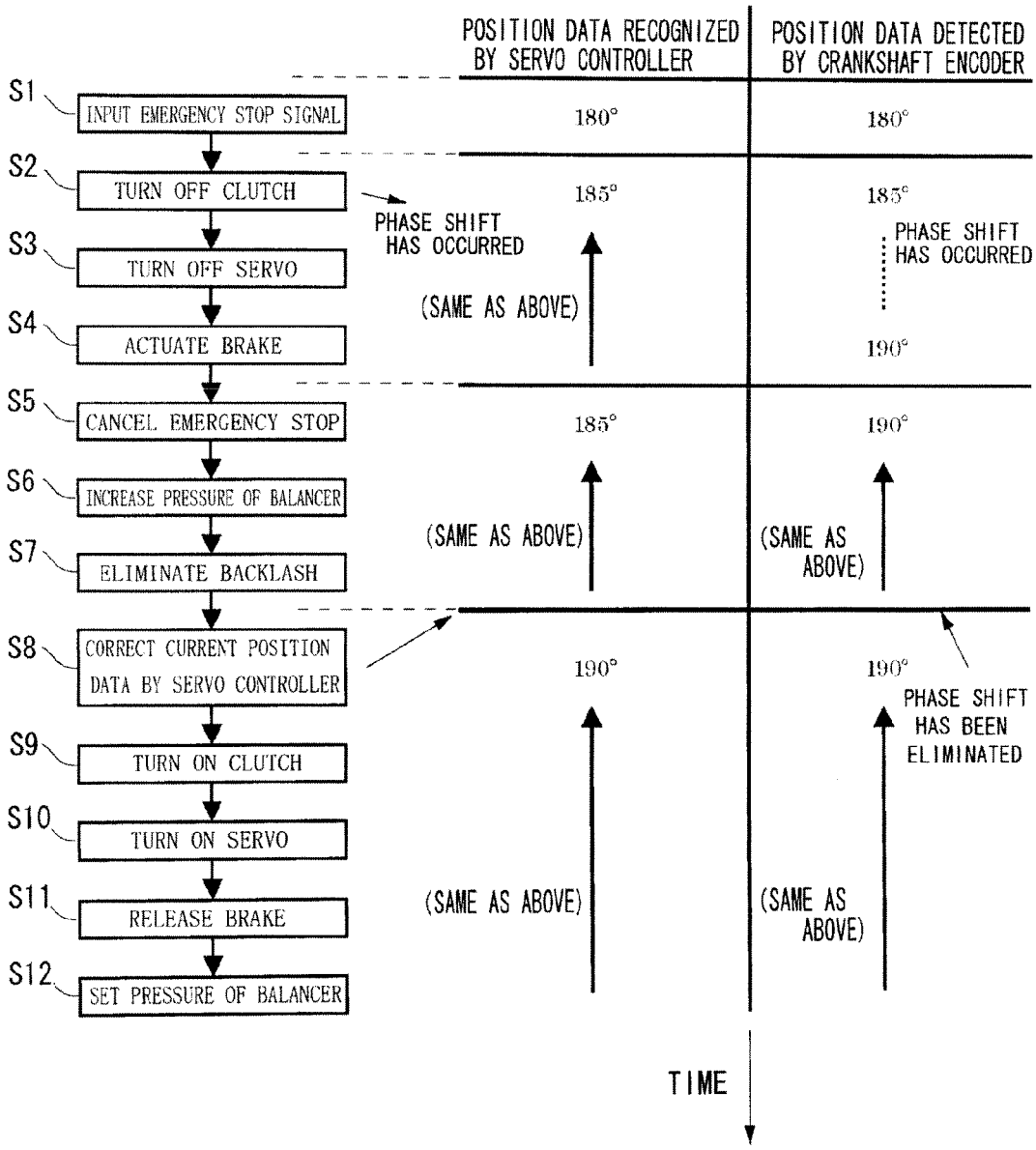
FIG. 3A is a control flow chart illustrating processing to be executed in the electric servo press machine according to the first embodiment.
FIG. 3B is a timing chart illustrating processing for recovery to a normal operation after an emergency stop signal is issued so that the electric servo press machine is stopped immediately.

That is, the electric servomotor 160 is temporarily disconnected from the power transmission path, and hence, at the time of recovery described above, a phase shift may occur between a rotational angle position of the rotating body (crankshaft 120) in the power transmission path, which ranges from the clutch mechanism 150 in the disconnected state to the slide 110, and a rotational angle position of an output rotation shaft of the electric servomotor 160 (see a timing chart of FIG. 3B).

The phase shift needs to be corrected for the recovery. As an example of the recovery method, for example, the following method may be employed. That is, the press control unit 500 which controls the electric servomotor 160 corrects a shift amount in rotational angle position information (internal data) of the electric servomotor 160, which is acquired based on information from a motor shaft encoder 161 of the electric servomotor 160, so that the rotational angle position information matches with rotational angle position information of the crankshaft 120, which is actually acquired by a crankshaft encoder 121 (see Step 8 (S8) in the control flow chart of FIG. 3A).

In this case, the motor shaft encoder 161 and the press control unit 500 correspond to a servomotor rotational angle position information acquiring device according to the present invention, and the crankshaft encoder 121 and the press control unit 500 correspond to a slide-side rotating body rotational angle position information acquiring device according to the present invention.

Further, the press control unit 500 corresponds to a control device according to the present invention.

Note that, the above-mentioned method involves only the changing of the internal data by the press control unit 500, and hence, unlike another recovery method described later, there is required no such operation of actually actuating the electric servomotor 160 to adjust the phases.

That is, before the clutch mechanism 150 is brought into the connected state, the shift amount in the rotational angle position information (internal data) of the electric servomotor 160, which is acquired based on the information from the motor shaft encoder 161 of the electric servomotor 160, can be corrected so that the rotational angle position information matches with the rotational angle position information of the crankshaft 120, which is actually acquired by the crankshaft encoder 121, and thereafter the clutch mechanism 150 can be brought into the connected state. On the other hand, after the clutch mechanism 150 is brought into the connected state, the shift amount in the rotational angle position information (internal data) of the electric servomotor 160, which is acquired based on the information from the motor shaft encoder 161 of the electric servomotor 160, can be corrected so that the rotational angle position information matches with the rotational angle position information of the crankshaft 120, which is actually acquired by the crankshaft encoder 121.

By the way, a backlash of the splines and gears is formed in the power transmission path ranging from the clutch mechanism 150 in the disconnected state to the slide 110, and hence, when the electric servomotor 160 side and the drive gear 140 (crankshaft 120) side, which are temporarily disconnected from each other, are connected again to each other by the clutch mechanism 150, an error (phase shift) may occur in an amount of the backlash between the rotational angle position of the crankshaft (position of the slide 110) and the rotational angle position of the electric servomotor 160.

Therefore, in this embodiment, for example, the gears are pressed on each other in a forward rotation direction or reverse rotation direction so as to bring about a state free from a clearance amount of the backlash, and the phases can be adjusted in this state.

That is, in this embodiment, in order to bring about the state free from the clearance amount of the backlash by causing the gears to abut on each other, a load is applied in the rotation direction of the rotating body (crankshaft 120) located in the power transmission path ranging from the clutch mechanism 150 in the disconnected state to the slide 110.

Specifically, in general press machines, a balance cylinder which suspends the slide and counterbalances the weight of the slide is installed for the purpose of reducing a burden on the power transmission path and the electric servomotor 160 during the pressing operation due to the weight of the slide. Therefore, at the time of recovery after the immediate stop, a balance cylinder 112 as illustrated in FIG. 2 is operated to pull up the slide 110 so that the load in the rotation direction is applied to the rotating body (crankshaft 120) located in the power transmission path ranging from the clutch mechanism 150 in the disconnected state to the slide 110. Accordingly, the gears located in the power transmission path abut on each other, to thereby bring about the state free from the clearance of the backlash in the rotation direction (see Step 6 (S6), Step 7 (S7) in the control flow chart of FIG. 3A).

When the load is applied, a tooth flank (or face) which abuts on a mating tooth flank (or face) is different between a case where the slide 110 is stopped while being lowered and a case where the slide 110 is stopped while being raised. When the slide is to be raised due to a suspension force of the balance cylinder, the suspension force is converted into a rotational force of the crankshaft. Assuming that the rotation direction of the crankshaft during the pressing operation is a forward rotation direction and the rotation direction opposite thereto is a reverse rotation direction, when the crankshaft is located short of a bottom dead center (when the slide is stopped while being lowered), the force for raising the slide is converted into a torque for rotating the crankshaft in the reverse rotation direction. On the other hand, when the crankshaft is located ahead of the bottom dead center (when the slide is stopped while being raised), the force for raising the slide is converted into a torque for rotating the crankshaft in the forward rotation direction. That is, in one tooth, which of the tooth flank oriented in the clockwise direction and the tooth flank oriented in the counterclockwise direction abuts on a mating tooth flank depends on the case where the slide 110 is stopped while being lowered and the case where the slide 110 is stopped while being raised.

Therefore, the press control unit 500 according to this embodiment recognizes based on the information from the crankshaft encoder 121 whether the slide 110 is being lowered or raised. Assuming that a positive value indicates that the slide 110 is being lowered, when the slide 110 is stopped immediately while being raised, the phases are adjusted by adding an amount corresponding to the angle of the backlash (shift amount). Accordingly, the phases can be adjusted with higher accuracy.

Detailed description is given with reference to the control flow chart of FIG. 3A. When the emergency stop signal is issued to perform immediate stop and thereafter the operation is to be recovered to the normal operation (press working), the press control unit 500 performs the following processing.

In Step ("S" in the FIG. 1, an emergency stop signal is input. When an operator manually operates an emergency stop button or an automatic detection system detects that a person has intruded into a dangerous area, an emergency stop device inputs the emergency stop signal to the press control unit 500.

In Step 2, the press control unit 500 transmits an OFF (disconnection) signal to the clutch mechanism 150, and the clutch mechanism 150 releases the rotational coupling between the drive gear 140 and the electric servomotor 160 to disconnect the electric servomotor 160 from the power transmission path.

In Step 3, the press control unit 500 turns OFF the drive power of the electric servomotor 160.

In Step 4, the press control unit 500 transmits a brake actuation signal to the brake solenoid valve 201 to actuate the brake mechanism 200. Accordingly, a brake is applied onto the brake gear 210 and therefore the main gear 130, and further onto the slide 110. Thus, the electric servo press machine 100 is stopped immediately.

In Step 5, when an emergency stop cancellation button or the like is operated or the abnormality detected by the automatic detection system is resolved, the press control unit 500 cancels the immediate stop in response to this event, and shifts to a recovery operation.

In Step 6, the press control unit 500 increases an internal pressure of the balance cylinder (balancer) 112, which is constructed of a hydraulic actuator or the like, to a predetermined value so as to apply a necessary load to the slide 110 and therefore the power transmission path.

In Step 7, through the application of a necessary load in a given direction in Step 6, the press control unit 500 brings about a state free from a clearance or a backlash in the power transmission path.

In Step 8, the press control unit 500 corrects a shift amount in the rotational angle position information (internal data) of the electric servomotor 160, which is acquired based on the information from the motor shaft encoder 161 of the electric servomotor 160, so that the rotational angle position information matches with the rotational angle position information of the crankshaft 120, which is actually acquired by the crankshaft encoder 121.

In Step 9, the press control unit 500 transmits an ON (connection) signal to the clutch mechanism 150, and the clutch mechanism 150 performs the rotational coupling between the drive gear 140 and the electric servomotor 160 to achieve a connected state in which the electric servomotor 160 is connected to the power transmission path.

In Step 10, the press control unit 500 turns ON the drive power of the electric servomotor 160.

In Step 11, the press control unit 500 cancels the operation of the brake mechanism 200 to release the brake applied onto the brake gear 210 and therefore the main gear 130, and further onto the slide 110.

In Step 12, the press control unit 500 controls the internal pressure of the balance cylinder (balancer) 112 to a value at the time of the normal operation, to thereby prepare for a recovered operation.

Through the processing described above, the press control unit 500 recovers to normal control after the immediate stop. Note that, the order of Step 8 and Step 9 may be changed.

As described above, according to this embodiment, the clutch mechanism 150 and the brake mechanism 200 are provided in the power transmission path, and at the time of immediate stop, the clutch mechanism 150 is released to stop the drive transmission of the electric servomotor 160, and the brake mechanism 200 is actuated. Accordingly, the electric servomotor 160 can be excluded from the components to be stopped, and the inertia at the time of stop can be reduced. As a result, the capacity of the brake can be reduced, thereby avoiding the capacity increase of the brake and the like.

Further, according to this embodiment, the phase shift between the electric servomotor 160 and the crankshaft 120, which occurs when the rotational coupling between the electric servomotor 160 and the crankshaft 120 (slide 110) is released by the clutch mechanism 150, can be corrected at the time of recovery to the normal operation after the immediate stop. Accordingly, it is possible to smoothly perform the press working after the recovery, and to smoothly perform cooperative working with other apparatus and facilities in a press working line, which is a system configured in cooperation with other apparatus and facilities.

That is, according to this embodiment, it is possible to provide the electric servo press machine which drives the slide via the power transmission path using the electric servomotor in a relatively simple and cost-efficient configuration. The electric servo press machine includes the clutch mechanism and the brake mechanism provided in the power transmission path, and at the time of, for example, immediate stop, the electric servomotor is disconnected from the power transmission path by the clutch mechanism, and the brake mechanism is actuated to stop the slide. In this electric servo press machine, when the electric servomotor is connected to the power transmission path again by the clutch mechanism, the phase shift between the electric servomotor side and the slide side can be eliminated, thereby smoothly recovering the operation to the normal operation.

Note that, when the backlash is small in the power transmission path ranging from the clutch mechanism 150 in the disconnected state to the slide 110, the electric servo press machine may be configured out of consideration of the backlash, and in this case, S6 and S7 in the control flow chart of FIG. 3A may be omitted.

Further, a manual operation may be performed so as to bring about the state free from the backlash in the power transmission path ranging from the clutch mechanism 150 in the disconnected state to the slide 110. For example, in a case where an operator can apply a load to the main gear 130 or the like in the rotation direction, the operations of S6 and S7 in the control flow chart of FIG. 3A may be replaced with manual operations.

Second Embodiment

A second embodiment of the present invention is different from the first embodiment only in the method of recovery to the normal operation after the immediate stop, and hence only this matter is described below.

That is, as the recovery method of the second embodiment, for example, the following method is employed. That is, as illustrated in Steps 108 to 111 (S108 to S111) in a control flow chart of FIG. 4A, the press control unit 500 which controls the electric servomotor 160 drives the electric servomotor 160 to rotate the electric servomotor 160 relative to the crankshaft 120 (rotating body located in the power transmission path ranging from the clutch mechanism 150 in the disconnected state to the slide 110) until the rotational angle position information of the electric servomotor 160, which is acquired based on the information from the motor shaft encoder 161 of the electric servomotor 160, matches with the rotational angle position information of the crankshaft 120, which is actually acquired by the crankshaft encoder 121. After that, the clutch mechanism 150 is brought into the connected state.

Figures 4A, 4B:
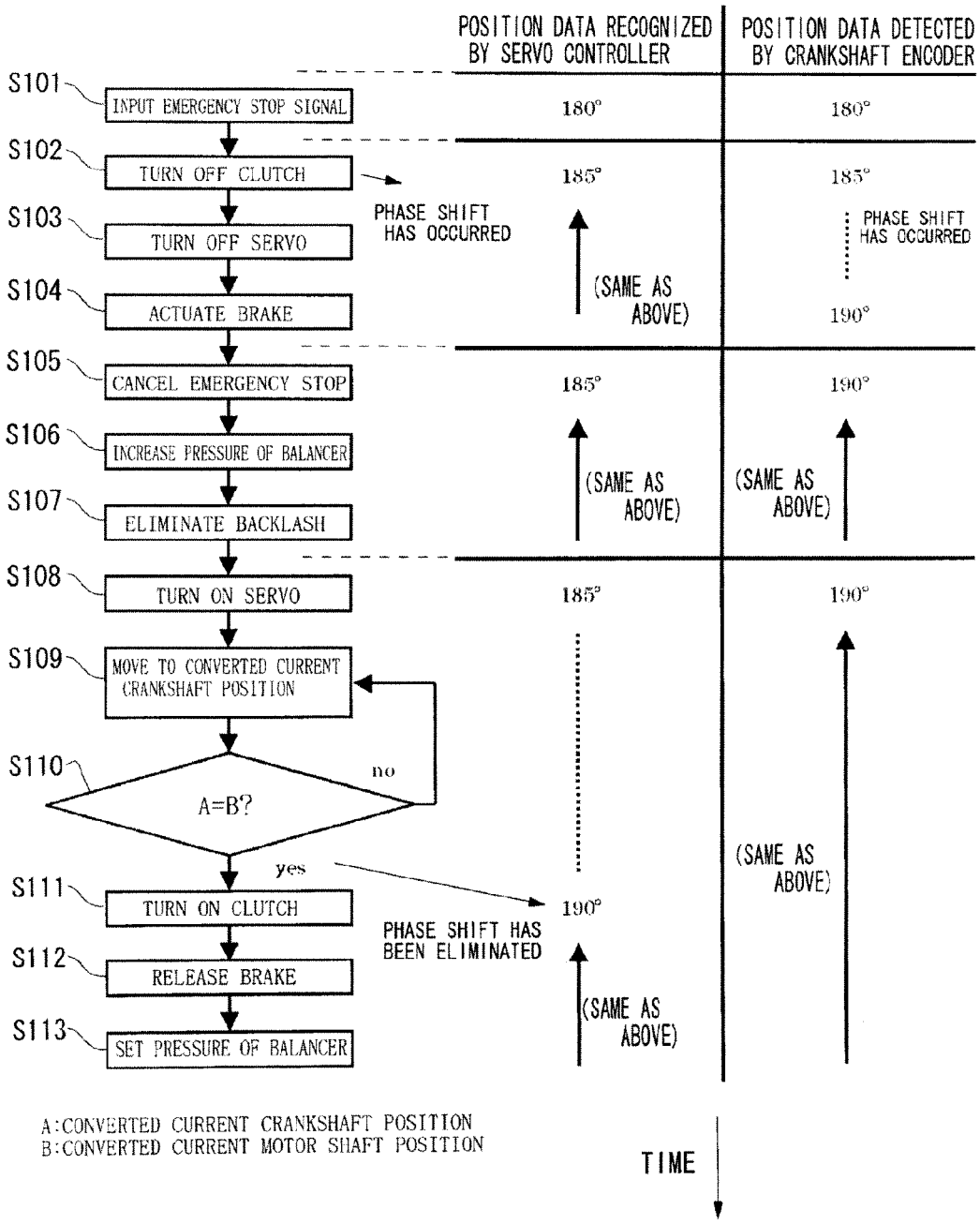
FIG. 4A is a control flow chart illustrating processing to be executed in the electric servo press machine according to the second embodiment.
FIG. 4B is a timing chart illustrating processing for recovery to the normal operation after the emergency stop signal is issued so that the electric servo press machine is stopped immediately.

Specifically, as illustrated in the control flowchart of FIG. 4A, through Steps 101 to 107, processing similar to that in Steps 1 to 7 of FIG. 3A is performed.

Subsequently, in Step 108, the press control unit 500 turns ON the drive power of the electric servomotor 160 for processing to be performed in Step 109.

In Step 109, the press control unit 500 acquires a converted current crankshaft position based on the crankshaft rotational angle position information, which is acquired based on a detection signal from the crankshaft encoder 121, and meanwhile calculates a converted current motor shaft position based on the rotational angle position information of the electric servomotor 160, which is acquired based on a detection signal from the motor shaft encoder 161. Based on the two pieces of current position data, the press control unit 500 generates a target position which can cancel the difference in phases between the crankshaft 120 and the electric servomotor 160, and outputs a target position command to the servo controller to actually rotate the electric servomotor 160.

In Step 110, the press control unit 500 updates the current positions, and determines whether or not the converted current crankshaft position and the converted current motor shaft position match with each other. The press control unit 500 repeats Steps 109 and 110 until the converted current crankshaft position and the converted current motor shaft position match with each other.

In Step 111, the press control unit 500 transmits an ON (connection) signal to the clutch mechanism 150, and the clutch mechanism 150 performs the rotational coupling between the drive gear 140 and the electric servomotor 160 to achieve a connected state in which the electric servomotor 160 is connected to the power transmission path.

In Step 112, the press control unit 500 cancels the operation of the brake mechanism 200 to release the brake applied onto the brake gear 210 and therefore the main gear 130, and further onto the slide 110.

In Step 113, the press control unit 500 controls the internal pressure of the balance cylinder (balancer) 112 to a value at the time of the normal operation, to thereby prepare for a recovered operation.

Through the processing described above, the press control unit 500 recovers to normal control after the immediate stop.

Thus, according to the second embodiment, as in the first embodiment, the clutch mechanism 150 and the brake mechanism 200 are provided in the power transmission path, and at the time of immediate stop, the clutch mechanism 150 is released to stop the drive transmission of the electric servomotor 160, and the brake mechanism 200 is actuated. Accordingly, the electric servomotor 160 can be excluded from the components to be stopped, and the inertia at the time of stop can be reduced. As a result, the capacity of the brake can be reduced, thereby avoiding the capacity increase of the brake and the like.

Further, according to the second embodiment, as in the first embodiment, the phase shift between the electric servomotor 160 and the crankshaft 120, which occurs when the rotational coupling between the electric servomotor 160 and the crankshaft 120 (slide 110) is released by the clutch mechanism 150, can be corrected at the time of recovery to the normal operation after the immediate stop. Accordingly, it is possible to smoothly perform the press working after the recovery, and to smoothly perform cooperative working with other apparatus and facilities in a press working line, which is a system configured in cooperation with other apparatus and facilities.

That is, according to the second embodiment, as in the first embodiment, it is possible to provide the electric servo press machine which drives the slide via the power transmission path using the electric servomotor in a relatively simple and cost-efficient configuration. The electric servo press machine includes the clutch mechanism and the brake mechanism provided in the power transmission path, and at the time of, for example, immediate stop, the electric servomotor is disconnected from the power transmission path by the clutch mechanism, and the brake mechanism is actuated to stop the slide. In this electric servo press machine, when the electric servomotor is connected to the power transmission path again by the clutch mechanism, the phase shift between the electric servomotor side and the slide side can be eliminated, thereby smoothly recovering the operation to the normal operation.

Note that, when the backlash is small in the power transmission path ranging from the clutch mechanism 150 in the disconnected state to the slide 110, the electric servo press machine may be configured out of consideration of the backlash, and in this case, S106 and S107 in the control flow chart of FIG. 4 may be omitted.

Further, a manual operation may be performed so as to bring about the state free from the backlash in the power transmission path ranging from the clutch mechanism 150 in the disconnected state to the slide 110. For example, in a case where an operator can apply a load to the main gear 130 or the like in the rotation direction, the operations of S106 and S107 in the control flow chart of FIG. 4 may be replaced with manual operations.

Third Embodiment

Figure 5:
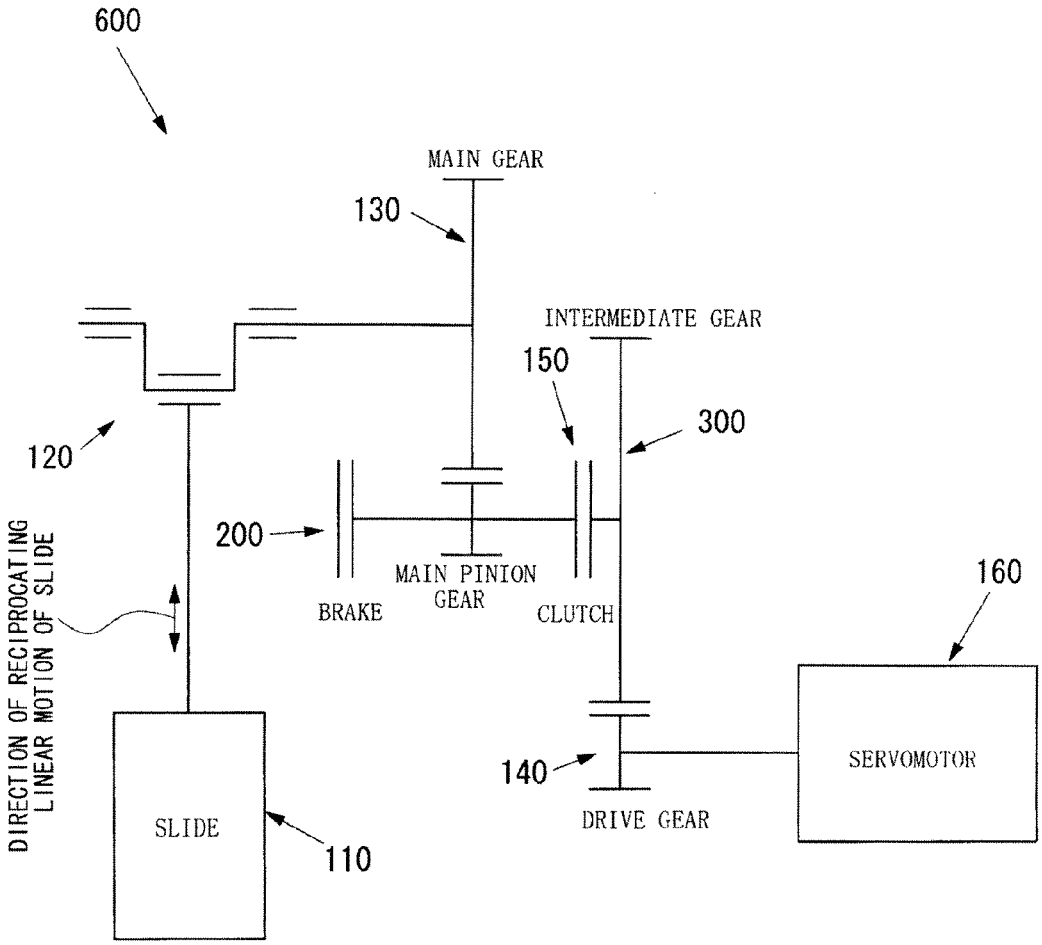
FIG. 5 is an overall configuration diagram schematically illustrating an overall configuration of a mechanical part of an electric servo press machine according to a third embodiment of the present invention.

A third embodiment of the present invention is an example in which the present invention is applied to an electric servo press machine 600 as illustrated in FIG. 5 other than the electric servo press machine 100 of the first and second embodiments illustrated in FIGS. 1 and 2.

Although the basic concept is the same as those in the first and second embodiments, the electric servo press machine 600 is different in layout from the electric servo press machine 100 of FIG. 1, and an intermediate gear 300 is interposed between the clutch mechanism 150 and the electric servomotor 160. With this configuration, there is an advantage in that a speed reduction ratio and the like can be set to desired values as compared to the first and second embodiments, that is, the degree of freedom in design is increased. In other respects, the configuration and control of the third embodiment are similar to those of the above-mentioned first and second embodiments, and a similar action and effect can be produced.

The embodiments described above are merely examples for illustrating the present invention. It is apparent that various changes are possible without departing from the gist of the present invention.

What is claimed is:

1. An electric servo press machine, which converts a rotation of an electric servomotor into a reciprocating linear motion of a slide through an intermediation of a power transmission/conversion mechanism, and utilizes the reciprocating linear motion of the slide to perform press working on a workpiece, the electric servo press machine comprising:

a clutch mechanism interposed in a power transmission path between the electric servomotor and the slide; and a brake mechanism capable of applying a brake onto a motion of the slide under a disconnected state in which the electric servomotor and the power transmission path are decoupled from each other by the clutch mechanism, the electric servo press machine being configured to:

bring the clutch mechanism into the disconnected state and apply the brake onto the motion of the slide by the brake mechanism in response to an immediate stop request; and recover from immediate stop under a state in which a phase shift between the electric servomotor and the power transmission path ranging from the clutch mechanism in the disconnected state to the slide is eliminated under a connected state of the clutch mechanism.

2. An electric servo press machine according to claim 1, further comprising:

a servomotor rotational angle position information acquiring device which acquires actual rotational angle position information of the electric servomotor;

a slide-side rotating body rotational angle position information acquiring device which acquires actual rotational angle position information of a rotating body located in the power transmission path ranging from the clutch mechanism in the disconnected state to the slide; and a control device which corrects the actual rotational angle position information of the electric servomotor, which is acquired by the servomotor rotational angle position information acquiring device, so that the actual rotational angle position information of the electric servomotor matches with the actual rotational angle position information of the rotating body on the slide side, which is acquired by the slide-side rotating body rotational angle position information acquiring device, to thereby eliminate the phase shift between the electric servomotor and the power transmission path ranging from the clutch mechanism in the disconnected state to the slide.

3. An electric servo press machine according to claim 1, further comprising:

a servomotor rotational angle position information acquiring device which acquires actual rotational angle position information of the electric servomotor;

a slide-side rotating body rotational angle position information acquiring device which acquires actual rotational angle position information of a rotating body located in the power transmission path ranging from the clutch mechanism in the disconnected state to the slide; and a control device which causes the electric servomotor to rotationally move so that the actual rotational angle position information of the electric servomotor, which is acquired by the servomotor rotational angle position information acquiring device, matches with the actual rotational angle position information of the rotating body on the slide side, which is acquired by the slide-side rotating body rotational angle position information acquiring device, to thereby eliminate the phase shift between the electric servomotor and the power transmission path ranging from the clutch mechanism in the disconnected state to the slide.

4. An electric servo press machine according to claim 2, wherein, when recovering from the immediate stop, under a state in which a load is applied to the power transmission path ranging from the clutch mechanism in the disconnected state to the slide so as to prevent at least a backlash, the servomotor rotational angle position information acquiring device acquires the actual rotational angle position information of the electric servomotor, and the slide-side rotating body rotational angle position information acquiring device acquires the actual rotational angle position information of the rotating body on the slide side.

5. An electric servo press machine according to claim 3, wherein, when recovering from the immediate stop, under a state in which a load is applied to the power transmission path ranging from the clutch mechanism in the disconnected state to the slide so as to prevent at least a backlash, the servomotor rotational angle position information acquiring device acquires the actual rotational angle position information of the electric servomotor, and the slide-side rotating body rotational angle position information acquiring device acquires the actual rotational angle position information of the rotating body on the slide side.

6. An electric servo press machine according to claim 4, further comprising a mechanism for applying the load to the power transmission path ranging from the clutch mechanism in the disconnected state to the slide, the mechanism utilizing a slide suspension force of a balance cylinder to apply the load to the power transmission path.

7. An electric servo press machine according to claim 5, further comprising a mechanism for applying the load to the power transmission path ranging from the clutch mechanism in the disconnected state to the slide, the mechanism utilizing a slide suspension force of a balance cylinder to apply the load to the power transmission path.

* * * * *